US005947849A

United States Patent [19]

Ellenbaum

[11] Patent Number: 5,947,849

[45] Date of Patent: Sep. 7, 1999

[54] POSITIONABLE BASKETBALL BACKBOARD

[76] Inventor: Linden Ellenbaum, 146 Highview Rd., Rockford, Minn. 55373

[21] Appl. No.: 09/005,502

[22] Filed: Jan. 12, 1998

[51] Int. Cl.[6] ..... A63B 63/08

[52] U.S. Cl. ..... 473/483

[58] Field of Search ..... 473/472, 479, 473/480, 481, 482, 483

[56] References Cited

U.S. PATENT DOCUMENTS

| | | | |
|---|---|---|---|
| 2,397,755 | 4/1946 | Schwab . | |
| 2,916,288 | 12/1959 | Chervenka | 473/482 |
| 3,881,724 | 5/1975 | Beveridge | 473/472 |
| 4,577,827 | 3/1986 | Eliscu . | |
| 4,643,422 | 2/1987 | Cramblett | 473/483 |
| 4,948,127 | 8/1990 | Willard | 473/483 |
| 5,102,127 | 4/1992 | Pohrer | 473/483 |

*Primary Examiner*—William H. Grieb
*Attorney, Agent, or Firm*—James R. Cwayna

[57] ABSTRACT

A positionable basketball backboard by which a basketball hoop may be positioned at predetermined, selected heights for playing the game. The unit includes standards which are mounted to a stationary support and slidable units received into the now stationary unit with guide means between the movable and stationary members which insures the non-racking movement of the shiftable backboard section. The guides include both bearings for simple sliding movement between the two units as well as axial or longitudinal guides. Both of the guiding elements serve to prevent racking during movement. The unit also includes positive stops to limit travel between the movable and stationary sections of the unit.

9 Claims, 10 Drawing Sheets

POSITIONABLE BASKETBALL BACKBOARD

SPONSORSHIP

This invention is not made under any Federal nor Independent sponsorship and is the result of the sole effort of the named inventor.

RELATED APPLICATIONS

The applicant has no applications on file and is not aware of any applications that should be considered during the prosecution of this application.

FIELD OF THE INVENTION

This invention relates generally to equipment for playing the game of basketball and more particularly to a structure for selectively raising and lowering the height of the backboard and attached hoop such that the game is more easily played by persons of various heights such as children, teens and adults.

SHORT SUMMARY OF THE INVENTION

A height adjustable backboard and attached hoop which includes structure for mounting the same to a supporting surface such as a wall or a single or number of vertical posts or standards which backboard includes first vertical standards for mounting to the support surface or supports with the backboard similarly arranged on second vertical supports which are slideably connected to the first vertical standards. The slidable connection allows the backboard and carried hoop to be vertically shiftable within predetermined limits and cooperative guide means are provided on both the first vertical standards and second vertical supports and carried backboard, to insure controlled vertical movement of the backboard and hoop with respect to the first vertical standards. The guide means includes pairs of bearing members and, further, stop means are provided to control the vertical movement of the backboard and carried hoop between predetermined limits. Various means, such as a mechanical screw device, are provided between the mounted portion of the unit and the slidable backboard to assist in moving the same between its selected limits and will effectively hold the backboard and hoop in a selected intermediate position.

The unit is designed to provide for smooth movement of the backboard and hoop between selected positions and the elevation thereof is determined by the height of the users for their enjoyment in playing the game.

BACKGROUND AND OBJECTS OF THE INVENTION

Basketball players are of various heights and it is often frustrating to children or persons of lesser heights than adults to play the game when the hoop is at such a height that it is virtually impossible to use.

Applicant is aware of various backboard units which permit selective placement of the backboard and attached hoop at selected heights and those that have been patented and which he considers to be of importance in the prosecution of this application are recited in the accompanying Prior Art Statement.

Most of these prior art units, although providing for the desired vertical movement and positioning of the backboard do not provide complete and positive control of possible lateral shifting or racking movement of the board with respect to the permanently mounted carrying standards and therefore, during vertical adjustment of the board, canting or the like may occur which prevents smooth movement of the board as it is moved vertically both upwardly and downwardly. This is eliminated with applicant's guiding system.

In addition to providing against lateral displacement, the applicant provides positive stop means for extreme upper and lower positioning of the backboard and hoop with respect to the support standards.

It is therefore an object of the applicant's invention to provide a positionable basketball backboard system wherein the movement of the backboard supports with respect to the stationary supports of the unit provides for positive guided movement as the backboard is shifted to and between desired vertical positions.

It is a further object of the applicant's invention to provide a positionable basketball backboard movement and guide system which includes guide devices between a first set of vertical standards which are mounted to a wall or other support arrangement and the vertical slidable supports which carry the backboard and mounted hoop.

These and other objects will more clearly appear from a consideration of the accompanying drawings and description.

DESCRIPTION OF A PREFERRED FORM OF THE INVENTION

Figure 5:
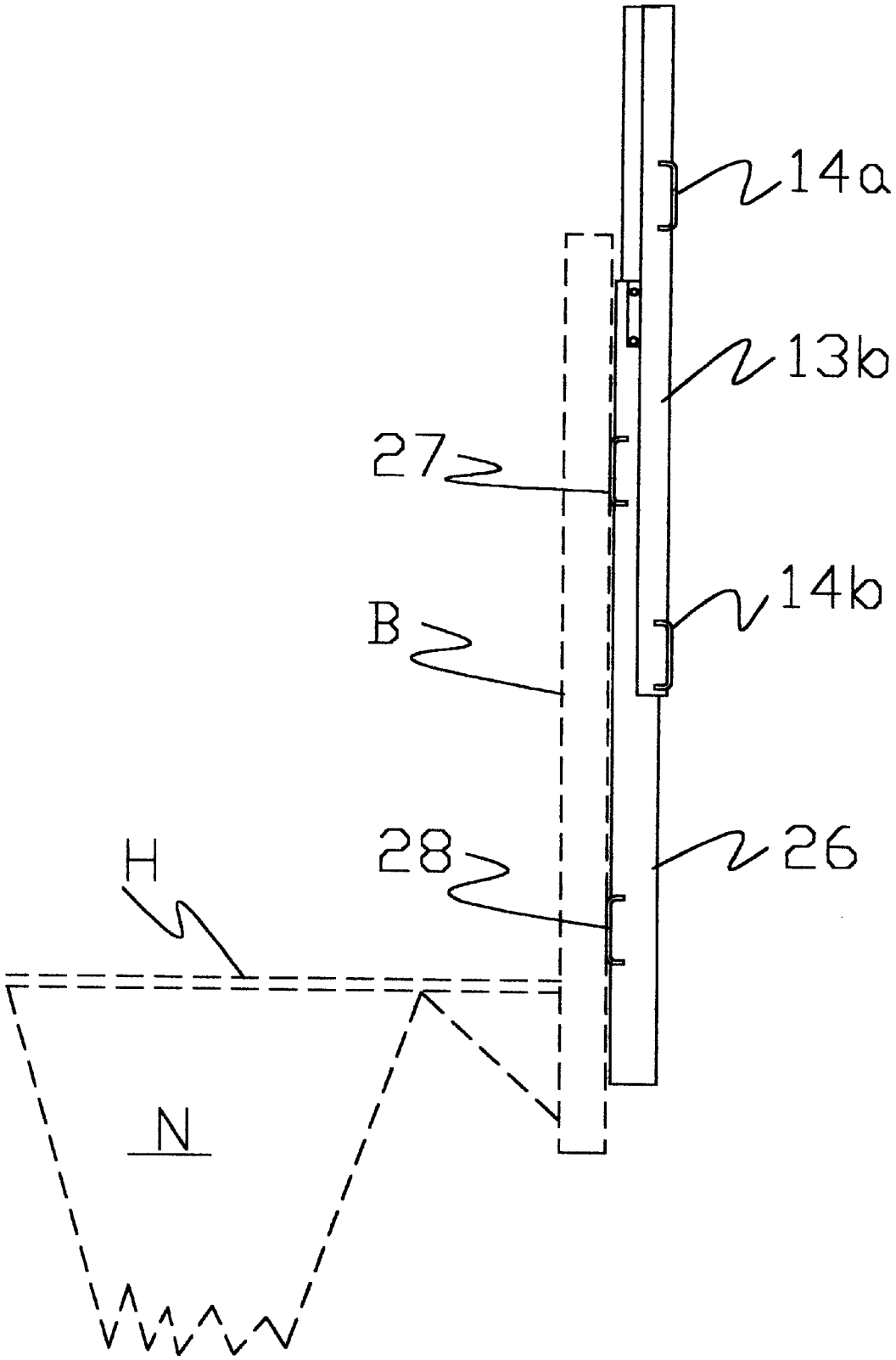
FIG. 5 is a side view of the unit in its lowermost position and having a backboard and hoop illustrated thereon in dotted lines.
Figure 6:
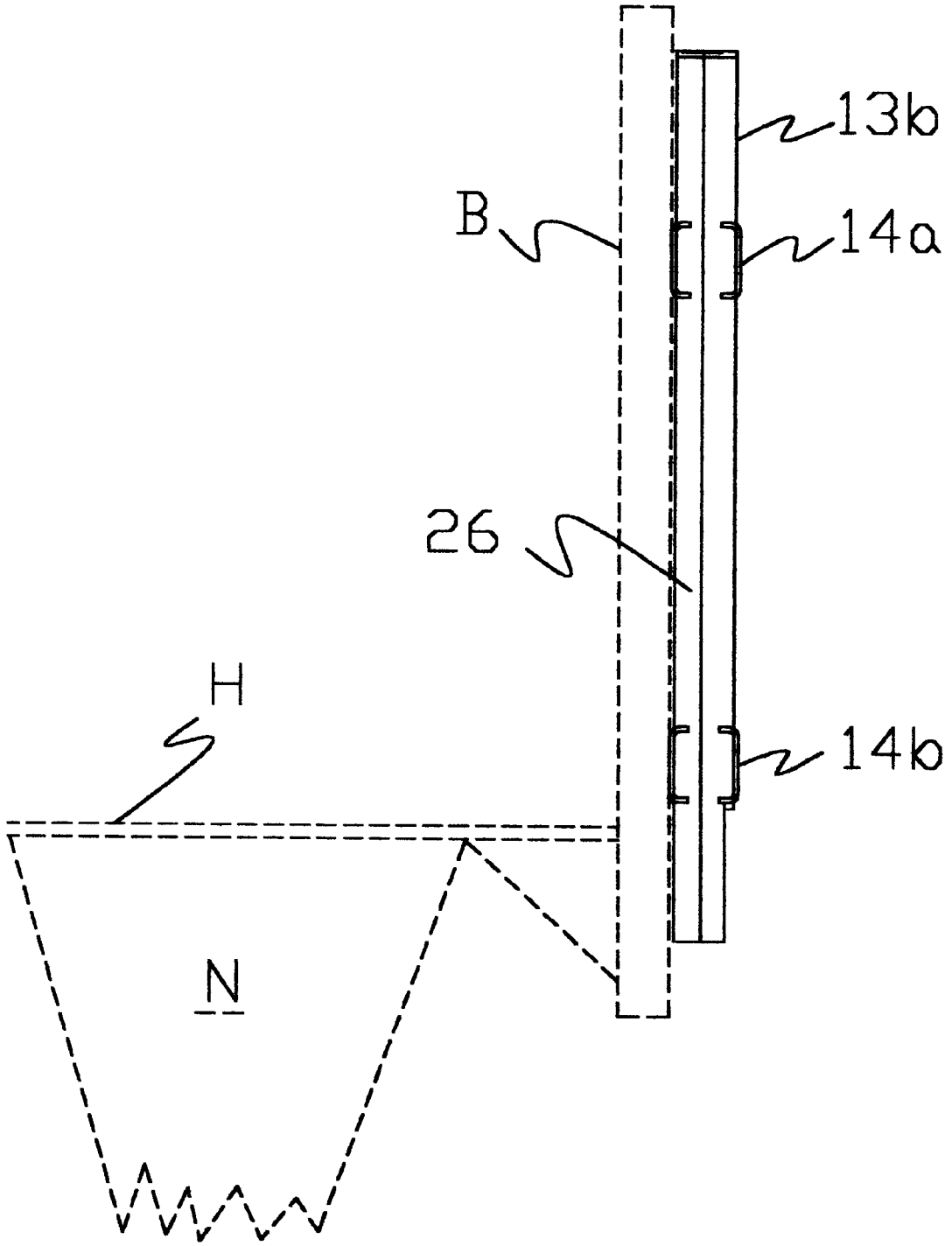
FIG. 6 is a side view of the unit, similar to FIG. 5 illustrating the unit in its uppermost position and again illustrating the backboard and hoop in dotted lines.

In accordance with the accompanying drawings, the Applicant's positionable basketball backboard is generally designated 10 and includes a wall or support mounting section 11 and a vertically shiftable, backboard and hoop mounting section 12. The hoop and backboard are illustrated in dotted lines in FIG. 5 and 6 and are designated respectively H and B. The hoop H will normally be provided with a net N.

Figure 7:
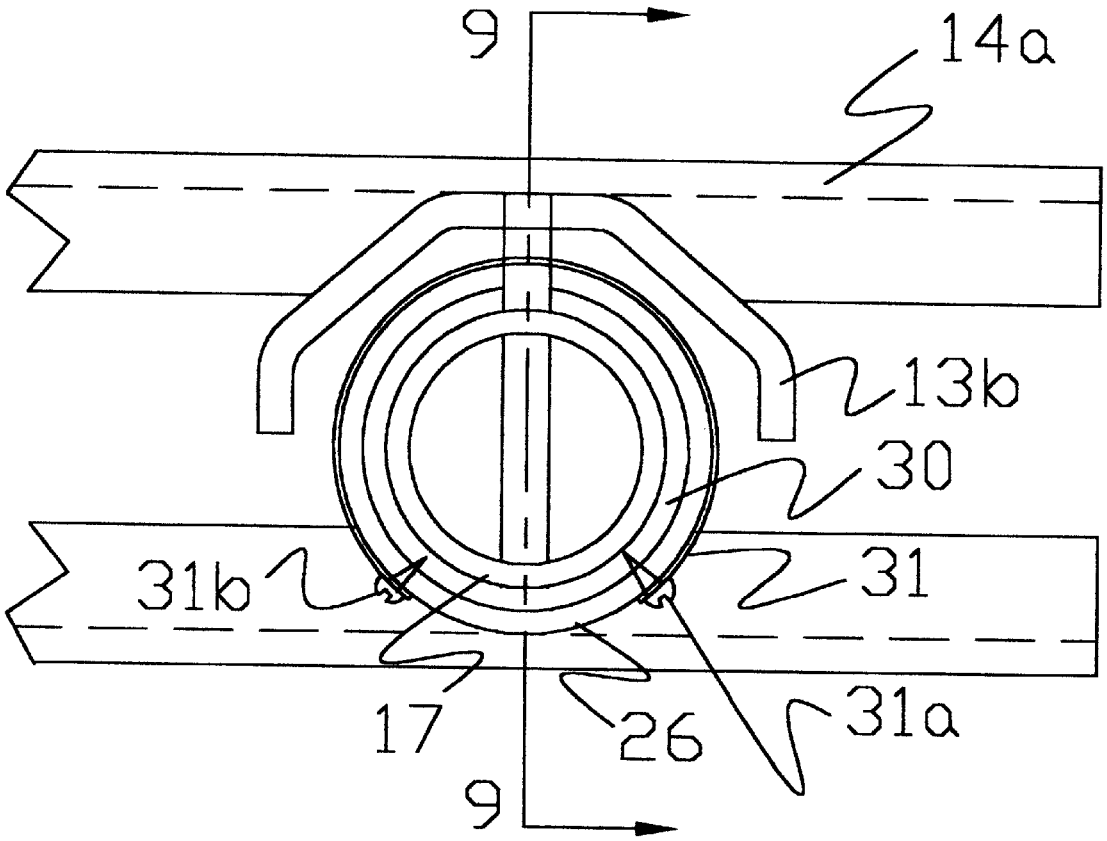
FIG. 7 is a horizontal section taken substantially along Line 7—7 of FIG. 2.

The wall or support mounting section 11 provides a framework which includes a pair of vertically positioned standards 13*a*, 13*b*, which are, as illustrated in FIG. 7, (one of such standards 13*b* being illustrated) substantially half-octagonal in shape. These two standards 13*a*, 13*b* are horizontally spaced along a pair of vertically spaced wall or support mounting stringers 14*a*, 14*b* each of which is provided with a pair of mounting apertures, all designated 15*a*, 15*b*. Each of the support standards 13*a*, 13*b* are provided with a positively mounted cap 13*c*, 13*d*. Support stringers 14*a*, 14*b* may be, as illustrated, of a C or channel shape to provide sufficient strength for the carried load and it should be noted that, as illustrated in FIG. 7 that the web of each such C-shape or channel stringer 14*a*, 14*b* is cut to receive the half-octagonally shaped standard 13*a*, 13*b*. Such cut and welding of the web provides a large welding or attachment area for joinder of the standards 13*a*, 13*b* to the stringers 14*a*, 14*b*.

The mounting apertures 15*a*, 15*b* permit the passage of selected fastener such that this framework section 11 may be secured to a wall or a pair of posts to hold the same in stationary position thereto.

Figure 8:
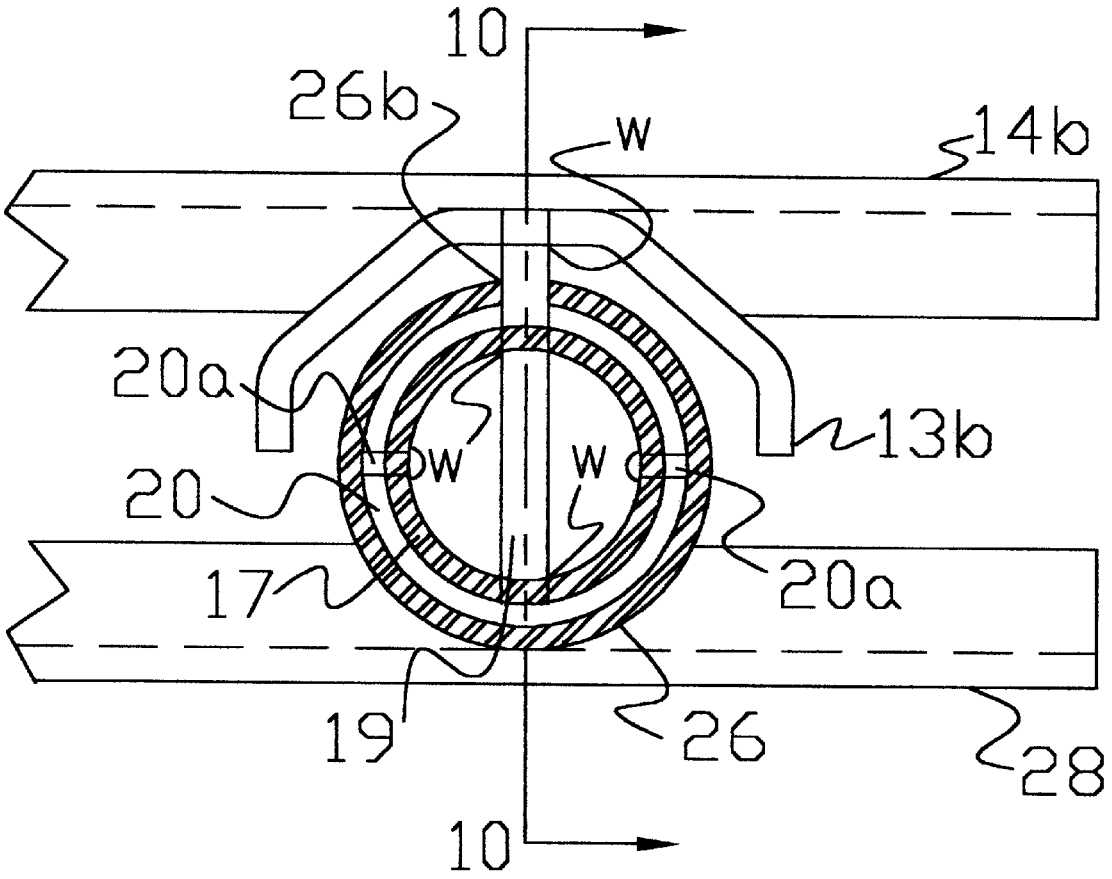
FIG. 8 is a horizontal section taken substantially along Line 8—8 of FIG. 2.
Figure 9:
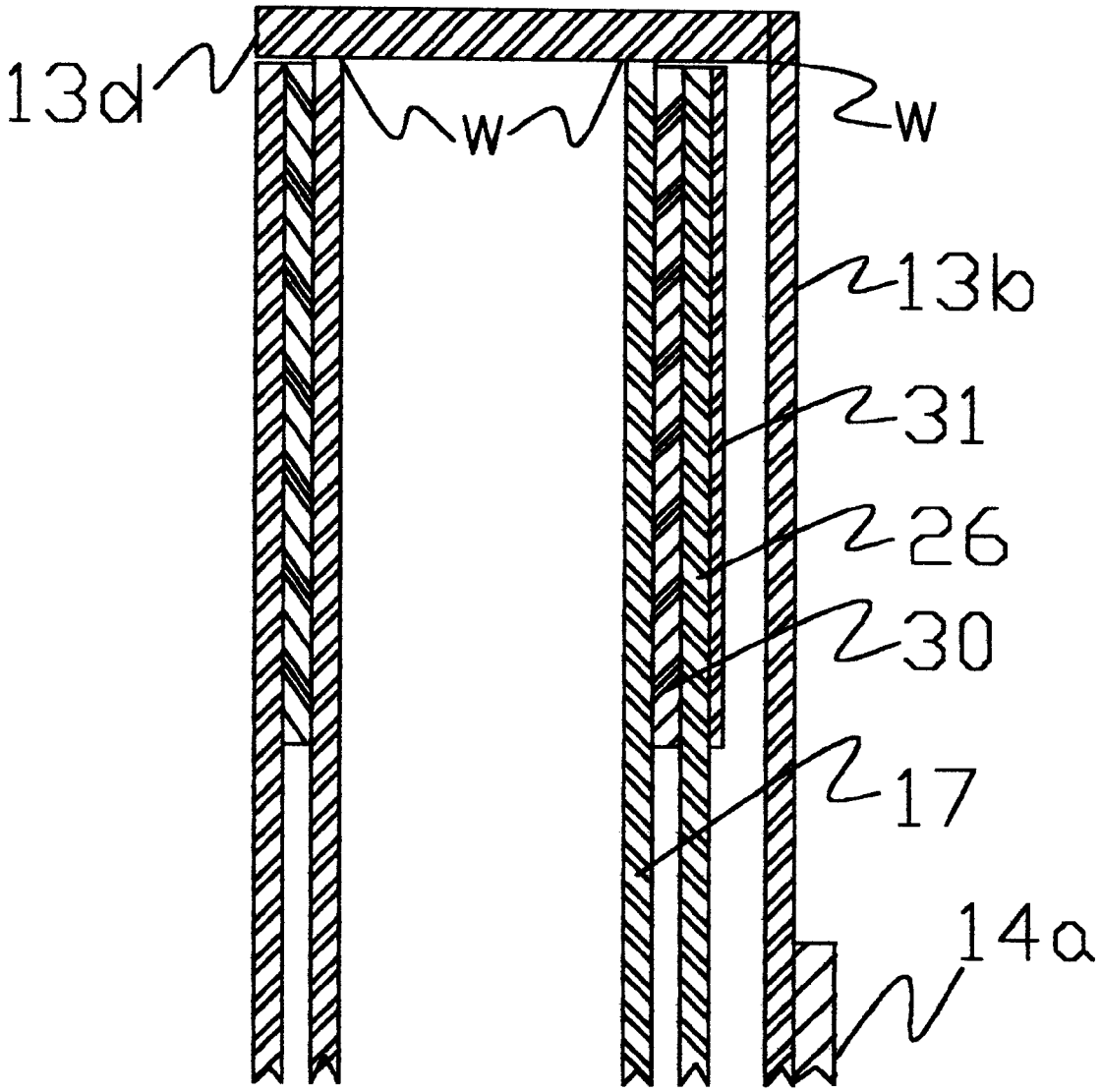
FIG. 9 is a partial vertical section taken substantially along Line 9—9 of FIG. 7; and, FIG. 10 is a partial vertical section taken substantially along Line 10—10 of FIG. 8.
Figure 10:
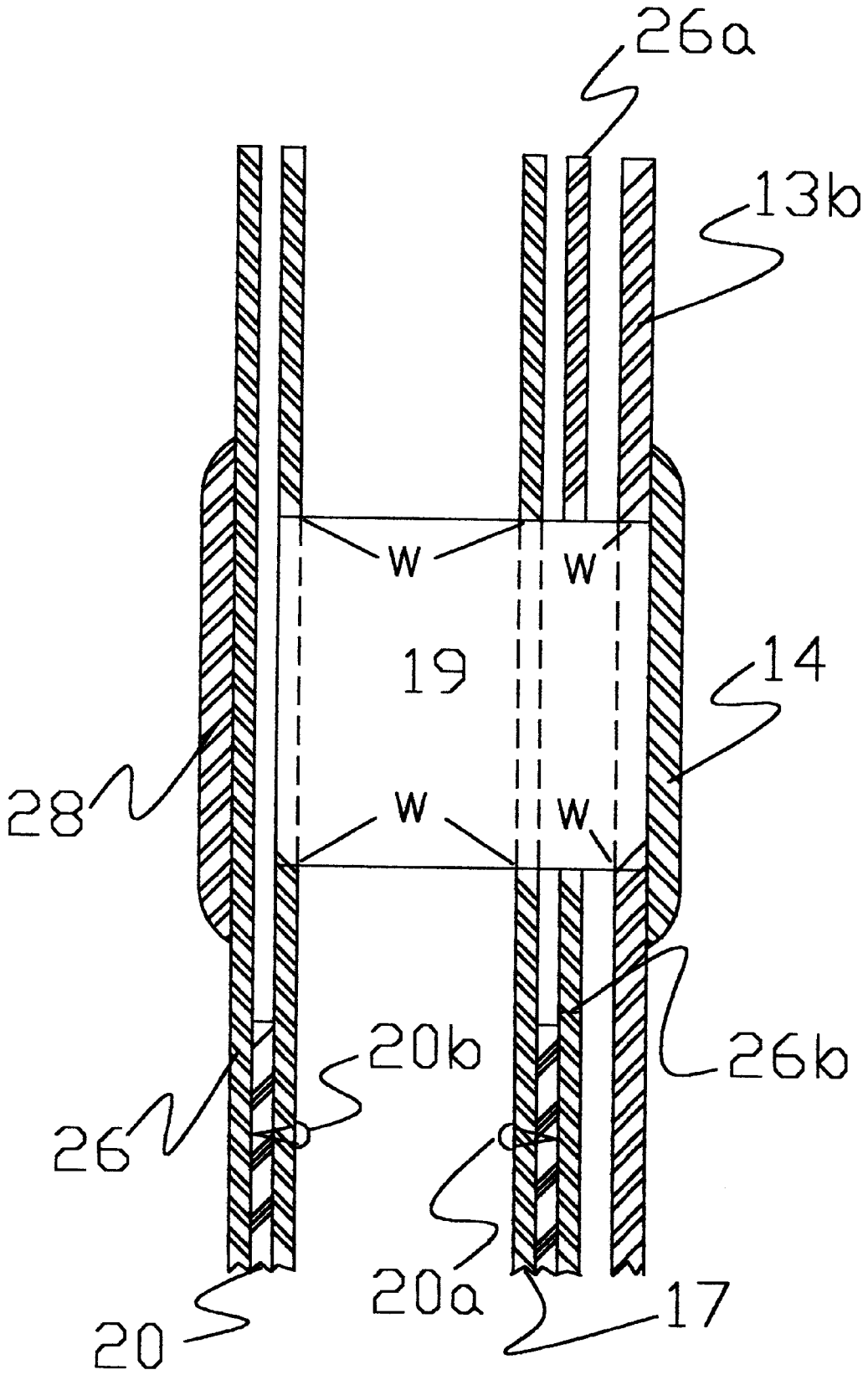

As illustrated in the various views, a longitudinally extending, inner, stationary rod or shaft member 16, 17 is provided within the shell of each of the octagonal standards 13*a*, 13*b* and is welded at the respective tops thereof to caps 13*c*, 13*d*, as particularly illustrated in FIG. 9, with the weld being designated W. Means for holding the lower ends of such rods or shafts 16, 17 is particularly illustrated in FIG. 8. In this view, a positive stop member 19 is illustrated which is substantially rectangular in shape with a predetermined width to be slidably received into a guide slot which will be described hereinafter. This stop member 19 is positively attached to the inner rods or shafts 16, 17 and the inner surface of the half-octagonal members 13*a*, 13*b* through welding or other techniques, with the welds again being designated W.

It should be particularly noted that the views of FIGS. 8 and 9 are illustrations wherein the backboard and hoop carrying framework, section 12, is in its uppermost position.

As illustrated in FIG. 8, a relatively short friction reducing bearing 20, of various selected materials, is provided about the inner rod or shaft 17 and is secured thereto by attachment elements 20*a*. This bearing member 20, then remains stationary with shaft 17 through vertical movement of the backboard and hoop carrying section 12. Such bearing member 20, though only one side of the unit being illustrated is similarly provided on rod or shaft 16.

The backboard and hoop carrying framework or section 12 consists of a pair of tubular or cylindrical members 25, 26 held in position by a pair of horizontally extending and vertically spaced backboard mounting stringers 27, 28. These stringers 27, 28 are provided with a pair of attachment element receiving apertures or slots all of which are designated 29*a*, 29*b*. These apertures obviously provide passage for the fastening means for holding the backboard B to the stringers 27, 28. Again, these stringers 27, 28 may be C-shaped or of channel configuration for strength and, as illustrated in FIGS. 7 and 8, the webs thereof may be removed to receive and be attached to the tubular or cylindrical members 25, 26.

Figure 1:
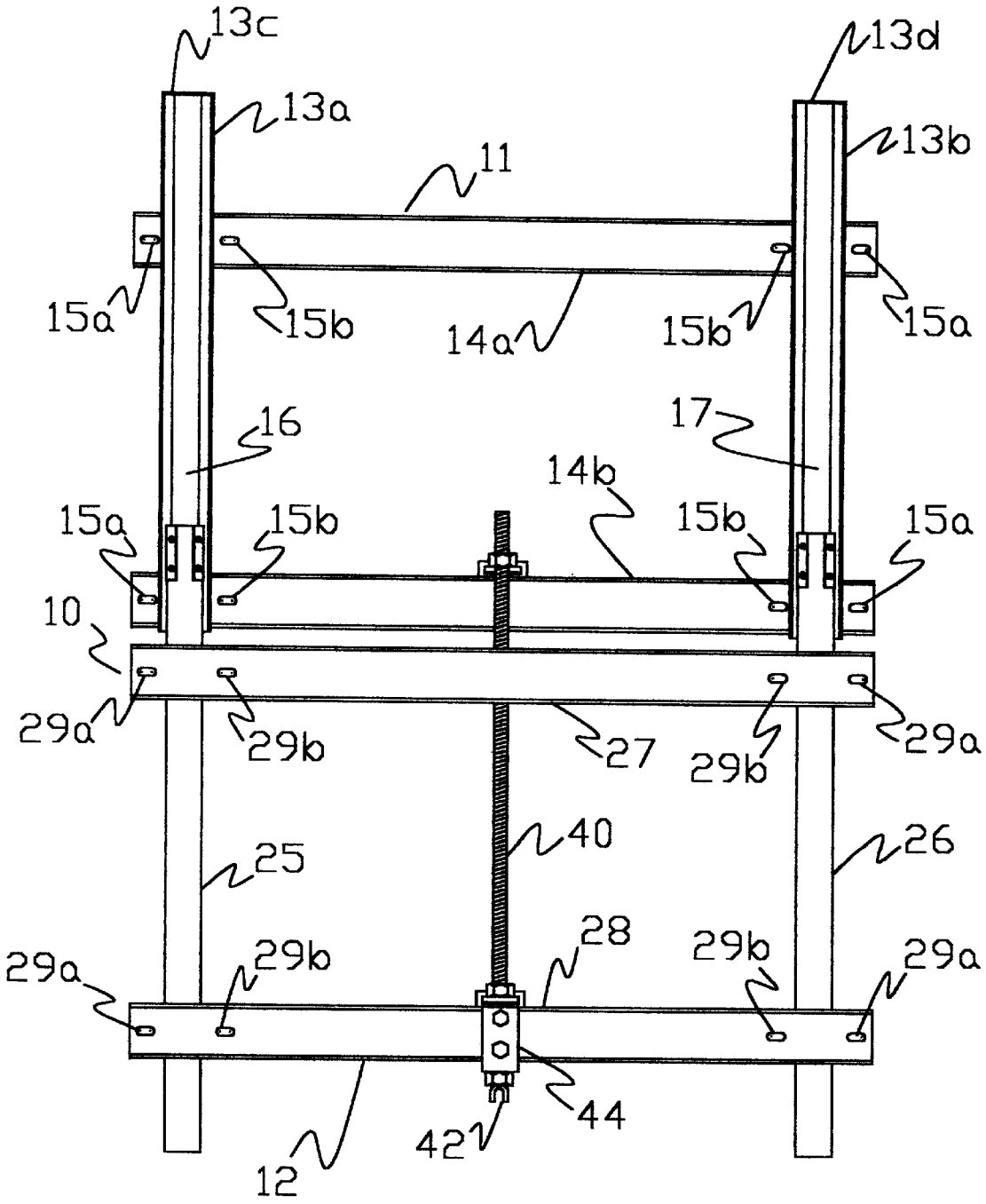
FIG. 1 is a front, side for mounting of the backboard, elevation of the positionable basketball backboard structure embodying the concepts of the Applicant's invention and illustrating the same at it's lowermost level, placing the backboard and hoop in its closest to ground position but not illustrating the backboard and hoop.
Figure 2:
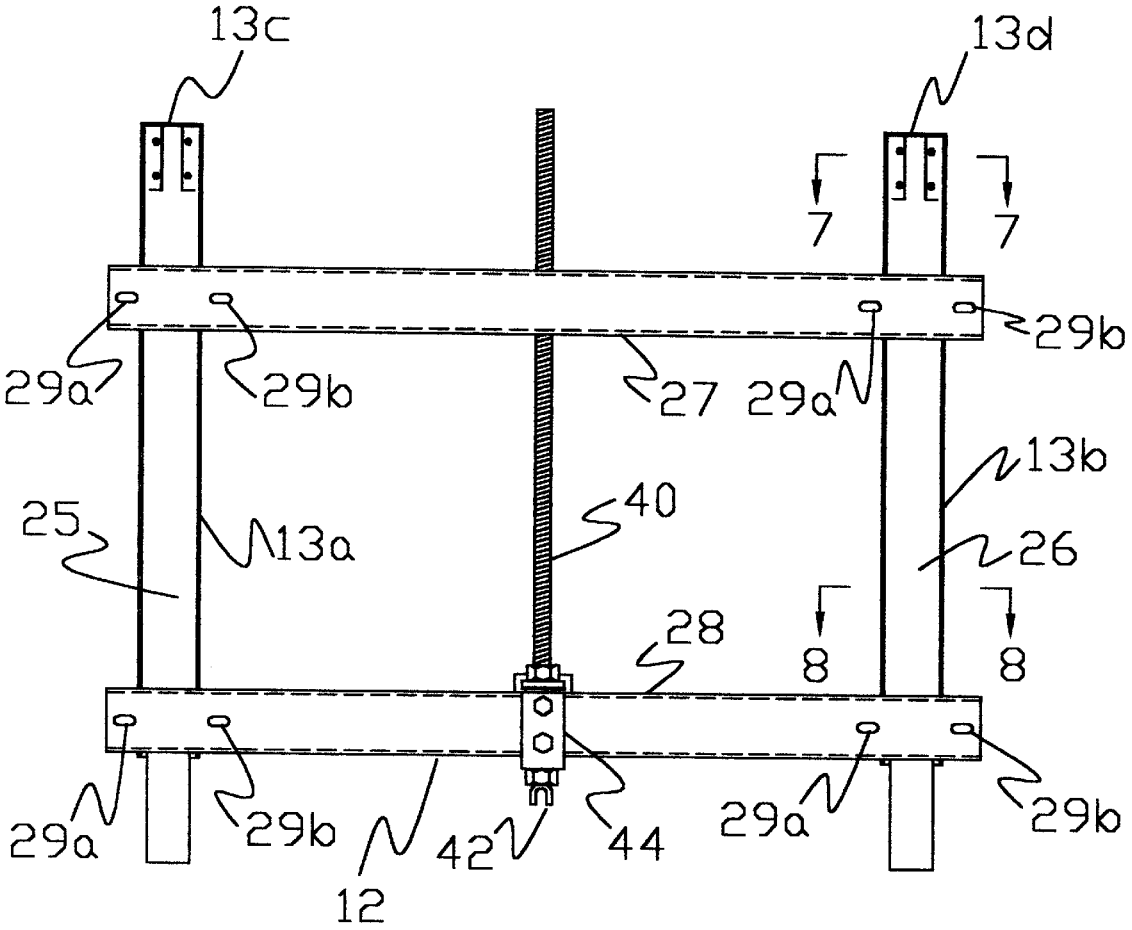
FIG. 2 is a front elevation of the positionable basketball structure of FIG. 1 in its uppermost level.
Figure 3:
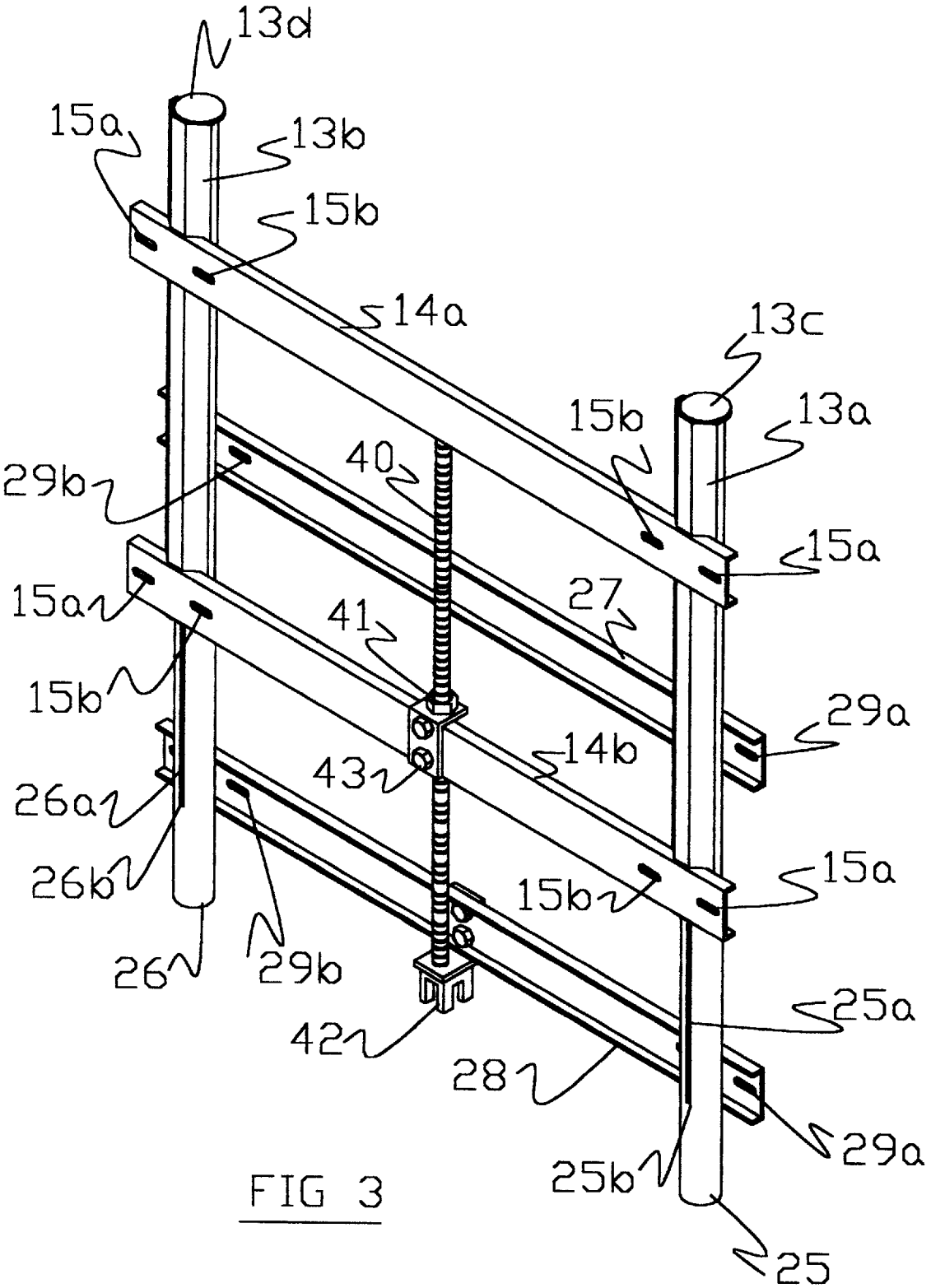
FIG. 3 is a rear perspective from the wall or support mounting side of the unit with the unit at its highest elevation.
Figure 4:
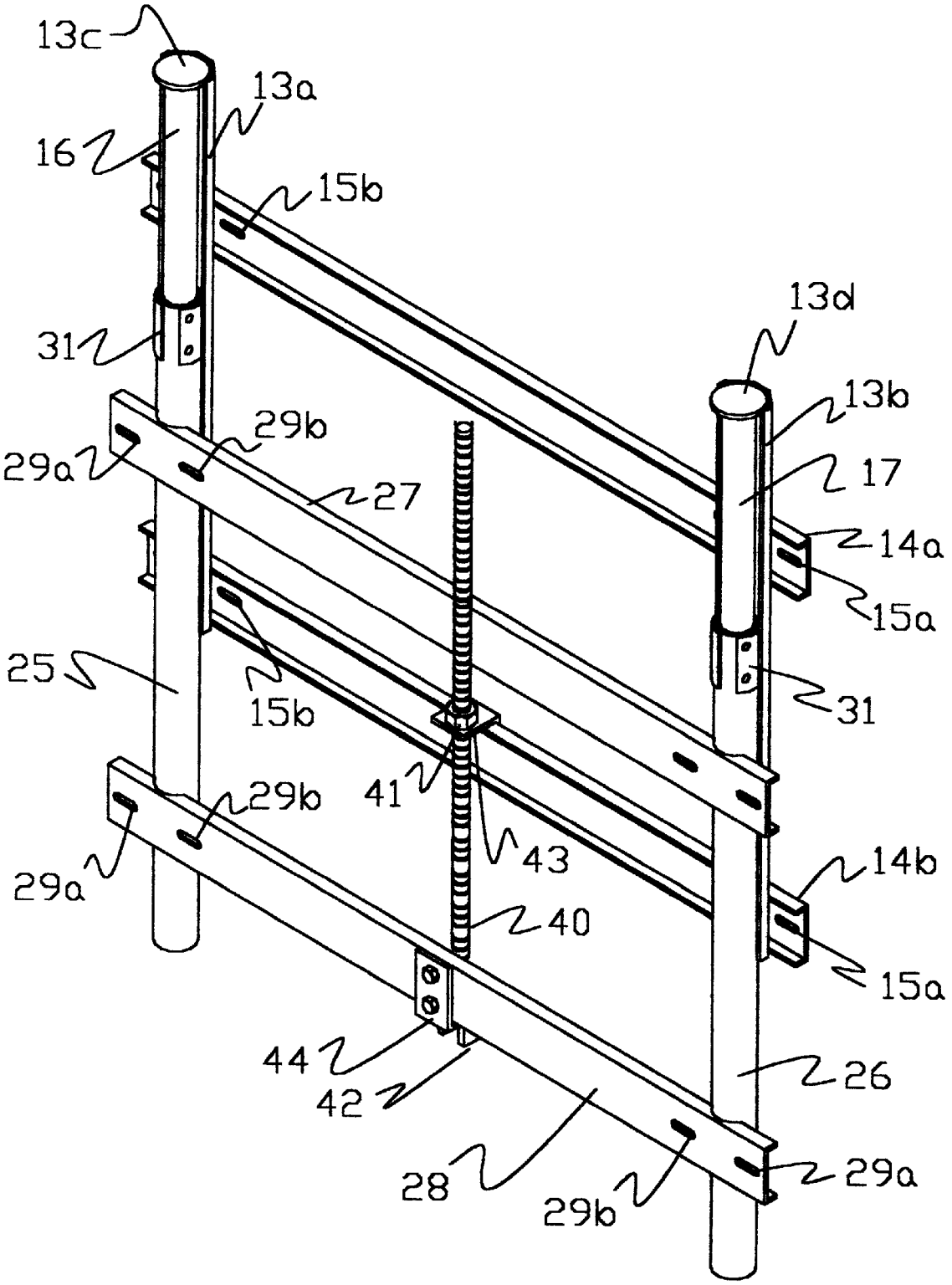
FIG. 4 is a rear perspective from the wall or support mounting side of the unit, corresponding to FIG. 3, with the unit at its lowest elevation.

As previously stated, the width of stop 19 is predetermined and the tubular members 25, 26 are provided with a longitudinally extending slot 25*a*, 26*a* (FIG. 3) to accommodate and slide along such stop 19. It should be obvious that this stop 19, slot 25*a*, 25*b* combination will assist to prevent racking of the section 12 as it is moved vertically with respect to section 11 as well as providing a limit stop for the upward movement of the backboard and hoop framework 12.

The construction of the upper ends of the rods or cylindrical members 25, 26 is particularly illustrated in FIGS. 7 and 9 and it should again be understood that such view are for one such rod or shaft 26 with the other rod or shaft 25 being identical thereto.

As illustrated in these Figures, a relatively short bearing or friction reducing member 30 is provided internally of the rods or tubular members 25, 26 and this friction member 30 also provides a base for the anchoring of a stop element 31 thereto by attachment elements 31*a*, 31*b*, which attachment elements 31*a*, 31*b* pass through the slots 26*a*, 26*ba* of such members. As compared to the lower structure, this bearing member 30 moves with the rods 25, 26 while the bearing 20 at the lower end of the unit remains stationary.

The stop member 31 serves as a stop for downward movement of the backboard and hoop carrying section 12 while the ends 25*b*, 26*b* of slots 25*a*, 26*a* and stop 19 serve as an upward movement stop.

Although applicant is aware that various non-mechanical, including electrical or, hydraulic devices may be utilized to gain the desired movement of the backboard and hoop framework 12 with respect to stationary unit 11, a form of mechanical means for adjusting the height of the backboard and hoop is illustrated. This unit is provided between the permanently mounted section 11 and the moveable section 12.

In the form shown, a mechanical screw 40 has its upper end 41 rotatably mounted within housing 43 of lower stringer 14*b* of the stationary section 11 while the opposite end of the screw 40 is longitudinally captured within housing 44 mounted on the lower stringer 28 of the moveable section 12. Upon rotation of the screw 40 through a crank (not shown) removably inserted into an extending clutch end 42 of screw 40, the lower or backboard and hoop mounting section 12 will be moved upwardly until the stop 19 engages the bottom 26*b* of slit 26 and similarly the slot and stop provided on the other member. Obviously reversal of direction of rotation of the screw 40 will cause the backboard and hoop carrying section to be lowered. By selecting a screw 40 of particular mechanical advantage, it should be obvious that intermediate locations other than full down and full up can be achieved as, with a properly selected screw, it will be self locking or holding against free rotation.

It should be obvious that the applicant has provided a unique height positionable backboard and hoop carrying unit that eliminates the possibilities of racking during movement between desired elevations and which always maintains its desired vertical alignment and thus hoop horizontal location, and with the limited bearing surface with the relatively short bearings utilized in his guiding system, the applicant drastically reduces the rotational power required to move the moveable section of his unit as compared to full contact guide units.

What I claim is:

1. A positionable basketball backboard including:

a. a first framework fixedly attachable to a support structure;

b. at least a pair of first vertically oriented guide means arranged on said first framework;

c. a second framework;

d. at least a pair of second vertically arranged guide means oriented on said second framework;

e. said first and second vertically oriented guide means including generally round, longitudinally extending members of predetermined sizes to permit positioning of said first of said guide means within the second of said guide means with bearing means arranged at the uppermost end of one of said guide means and at the lower end of the other of said guide means to provide bearing guiding throughout movement between the two guide means;

f. first stop means provided on one of said pairs of guide means to limit upward movement of said second framework with respect to to said second framework with said stop means being secured to said second framework and the lowermost end of said first vertically arranged guide means for positioning the lowermost end thereof; and, g. means for attaching a basketball backboard and hoop to to said second framework to expose the same for basketball playing use.

2. The positionable basketball backboard as set forth in claim 1 and said bearing means being of relatively short length as compared to the length of said guide means.

3. The positionable basketball backboard as set forth in claim 2 and one of said bearings being positioned at the uppermost end of said second guide means and positioned to contact said stop when said guide means is moved downwardly to limit the downward movement of said second guide and attached backboard and hoop.

4. The positionable basketball backboard as set forth in claim 3 wherein said bearing is arranged internally of said second guide means and an additional stop element is arranged exteriorally of said second guide means adjacent said bearing means and positioned to engage said stop when said guide means is moved downwardly to assist in limiting the downward movement of said second guide and attached backboard and hoop.

5. The positionable basketball backboard as set forth in claim 1 and said stop means being secured to said first framework and the lowermost end of said first vertically oriented guide means for positioning the lowermost end thereof.

6. The positionable basketball backboard as set forth in claim 5 and a longitudinal slot provided in said second guide means whereby said second guide means is shiftable longitudinally along said stop means and engaging the same at the bottom of said slot to limit the upward movement of such guide and the attached backboard and hoop.

7. The postionable basketball backboard as set forth in claim 1 and partial, vertically oriented enclosure mounted on said first framework, said first of said vertically oriented guide means being positioned therein and spaced therefrom.

8. The positionable basketball backboard as set forth in claim 1 and positioning means arranged between said first framework and said second framework for shifting said second framework and carried backboard and hoop with respect to said first framework.

9. The positionable basketball backboard as set forth in claim 8 wherein said positioning means includes a mechanical screw.

* * * * *